US008632305B2

(12) United States Patent
Zhang et al.

(10) Patent No.: US 8,632,305 B2
(45) Date of Patent: Jan. 21, 2014

(54) FAN ASSEMBLY

(75) Inventors: Jun-Xiong Zhang, Shenzhen (CN); Zhi-Xin Li, Shenzhen (CN); Bang-Wei Wang, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 510 days.

(21) Appl. No.: 12/973,796

(22) Filed: Dec. 20, 2010

(65) Prior Publication Data

US 2012/0141265 A1 Jun. 7, 2012

(30) Foreign Application Priority Data

Dec. 6, 2010 (CN) ..... 2010 1 0574554

(51) Int. Cl.
*F04D 29/60* (2006.01)

(52) U.S. Cl.
USPC ..... 415/213.1; 416/244 R

(58) Field of Classification Search
USPC ..... 415/213.1, 214.1, 232; 416/244 R; 361/695
See application file for complete search history.

(56) References Cited

U.S. PATENT DOCUMENTS

| | | | | |
|---|---|---|---|---|
| 6,587,342 | B1 * | 7/2003 | Hsu | 361/695 |
| 7,771,165 | B2 * | 8/2010 | Chen | 415/213.1 |
| 2003/0175123 | A1 * | 9/2003 | Yeh | 416/246 |
| 2008/0253886 | A1 * | 10/2008 | Chen | 415/213.1 |

* cited by examiner

*Primary Examiner* — Dwayne J White
(74) *Attorney, Agent, or Firm* — Altis Law Group, Inc.

(57) ABSTRACT

A fan assembly includes a fan, and a fan holder for receiving the fan. The fan holder includes a first mounting member and a second mounting member. A first side of the second mounting member is pivotably attached to the first mounting member. A second side of the second mounting member is locked to the first mounting member to receive the fan between the first and second mounting members.

14 Claims, 3 Drawing Sheets

FAN ASSEMBLY

BACKGROUND

1. Technical Field

The disclosure relates to heat dissipation, and particularly to a fan assembly.

2. Description of Related Art

Fans are often mounted in electronic devices with screws to dissipate heat. However, when servicing or replace the fans, the screws are inconvenient to unscrew.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
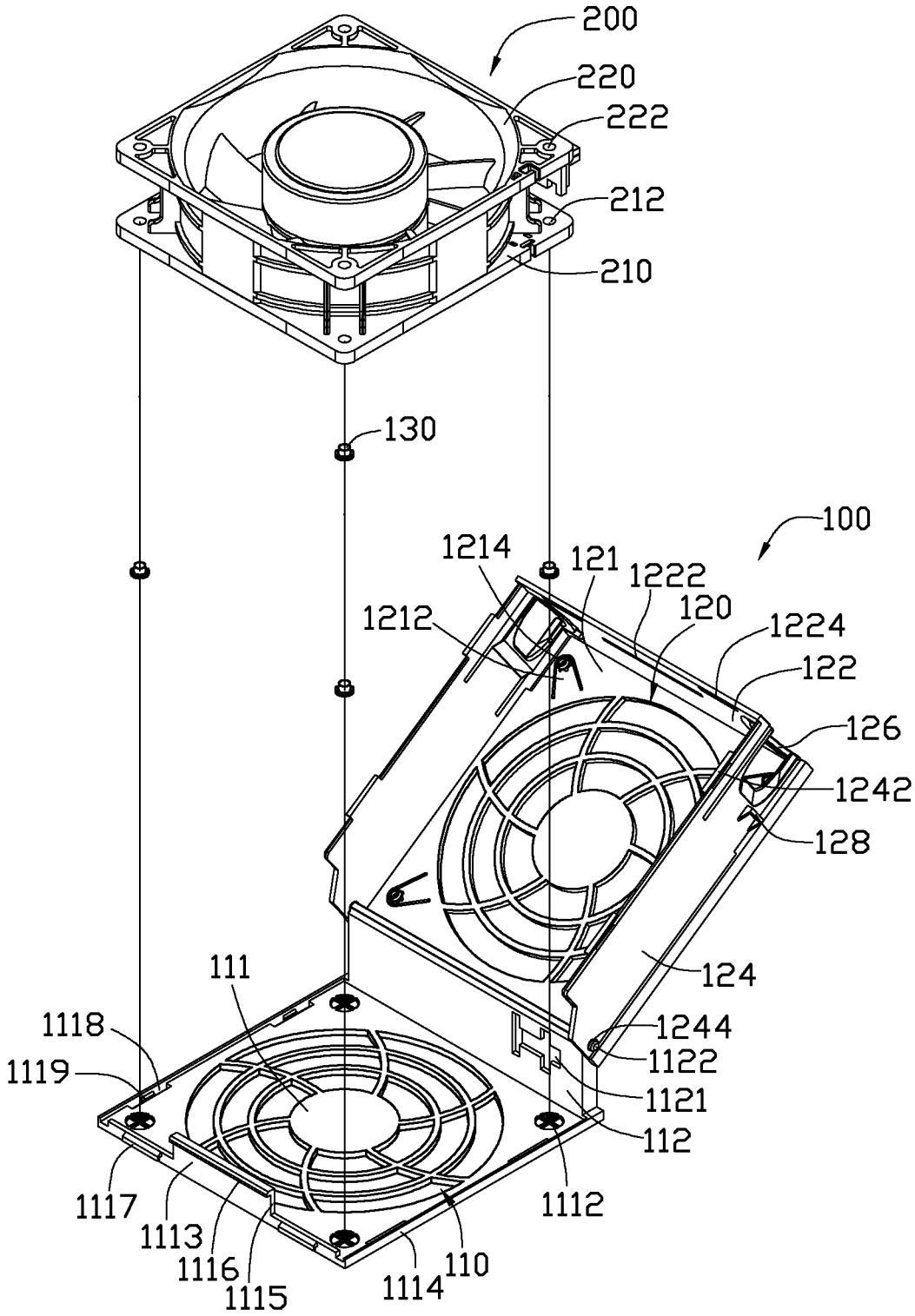
FIG. 1 is an isometric, exploded view of an embodiment of a fan assembly.

Referring to FIG. 1, a fan assembly includes a fan holder 100, and a fan 200 received in the fan holder 100.

The fan 200 includes a substantially rectangular first plate 210, and a substantially rectangular second plate 220 opposite and substantially parallel to the first plate 210. A first mounting hole 212 is defined in each corner of the first plate 210. A second mounting hole 222 is defined in each corner of the second plate 220.

The holder 100 includes a first mounting member 110, a second mounting member 120, and a plurality of resilient members 130. The first mounting member 110 is substantially L-shaped and includes a rectangular base wall 111 and a sidewall 112 substantially perpendicularly extending from a first side of the base wall 111. A plurality of vents (not labeled in the figures) is defined in a center of the base wall 111. A post 1112 extends from each corner of the base wall 111. The base wall 111 includes a first flange 1113 extending from a second side of the base wall 111 opposite to the sidewall 112, and two parallel second flanges 1114 respectively extending from a third and a fourth sides of the base wall 111 connected between the first and second sides. A first hook 1115 extends from a middle of the first flange 1113. A substantially wedge-shaped protrusion 1116 protrudes from a distal of the first hook 1115. Two substantially L-shaped second hooks 1117 extend from the first flange 1113, at opposite sides of the first hook 1115. Two locking slots 1118 are defined in base wall 111 adjacent to each second flange 1114. A block 1119 protrudes from an inner surface bounding each locking slot 1118. A through hole 1121 is defined in the sidewall 112 for mounting a cable connector for the fan 200. Two poles 1122 extend from opposite sides of an upper portion of the sidewall 112.

The second mounting member 120 includes a base plate 121. The base plate 121 includes a first end, a second end opposite to the first end, and two parallel sides. An end plate 122 extends from the second end of the base plate 121. Two parallel side plates 124 extend from the parallel sides of the base plate 121. A plurality of vents (not labeled) is defined in a center of the base plate 121. Each corner of the base plate 121 defines a substantially U-shaped slot to form a tongue shaped resilient tab 1212. A post 1214 extends from a distal end of each tab 1212. The end plate 122 defines a first locking hole 1222 in a middle of the end plate 122, and two second locking holes 1224 at opposite sides of the first locking hole 1222 respectively. Two spaced locking portions 1242 are formed on a side of each side plate 124 opposite to the base plate 121. A pivot hole 1244 is defined in each side plate 124 adjacent to the first end of the base plate 121. A holding portion 126 is formed at two opposite corners where the end plate 122 and the side plates 124 meet, for conveniently holding the fan holder 100. A blocking portion 128 extends from each side plate 124 adjacent to each holding portion 126, for fastening the fan holder 100 in an enclosure (not shown in the figures).

Each resilient member 130 is a substantially T-shaped hollow rubber washer.

Figure 2:
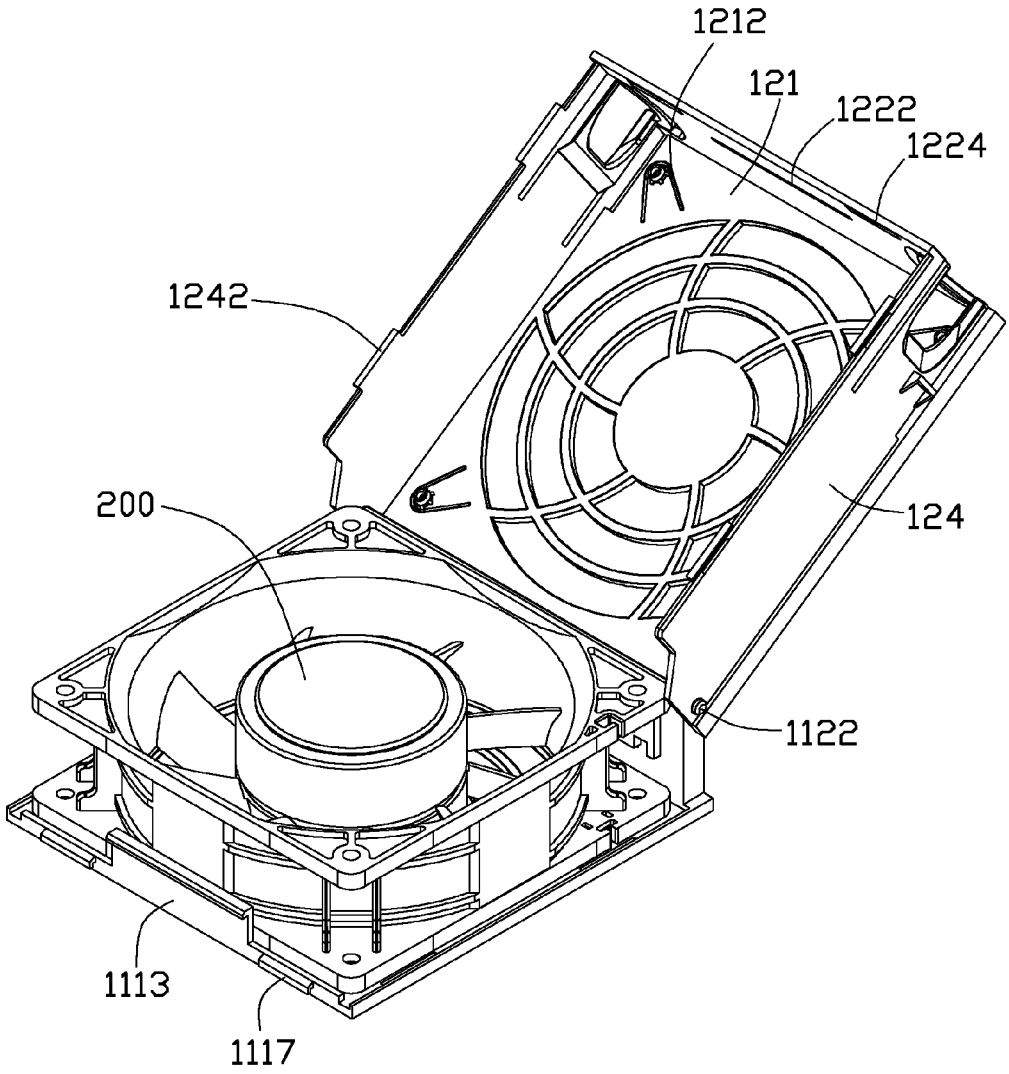
FIG. 2 and FIG. 3 are isometric, assembled views of the fan assembly of FIG. 1, showing different use states.

Referring to FIG. 2, in assembly, the poles 1122 of the sidewalls 112 of the first mounting member 110 are respectively engaged in the pivot holes 1244 of the second mounting member 120. The resilient members 130 are respectively set around the posts 1112 of the base wall 111.

Figure 3:
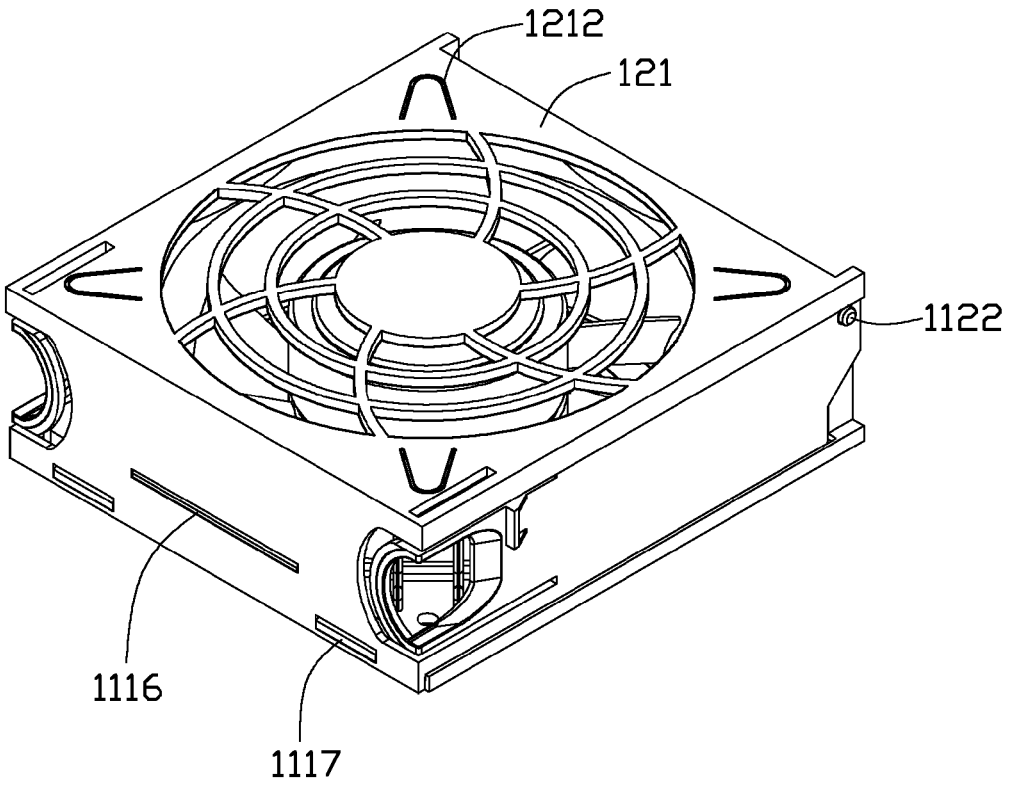

Referring to FIG. 3, in use, the first plate 210 of the fan 200 is aligned with the first mounting member 110 of the fan holder 100, the posts 1112 of the base wall 111 are engaged in the corresponding first mounting holes 212 of the fan 200, with the resilient members 130 arranged between the first mounting holes 212 and the posts 1112. The second mounting member 120 is pivoted to cover the first mounting member 110. The posts 1214 of the second mounting member 120 engage in the corresponding second mounting holes 222 of the second plate 220 of the fan 200. The protrusion 116 of the first hook 1115 of the first mounting member 110 is locked to the first locking hole 1222 of the second mounting member 120. The second hooks 1117 of the first mounting member 110 are locked to the second locking holes 1224 of the second mounting member 120 respectively. The locking portions 1242 of the second mounting member 120 are engaged in the corresponding locking slots 1118 of the first mounting member 110 respectively, to be locked to the blocks 1119.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A fan assembly, comprising:

a fan;

a fan holder comprising a first mounting member and a second mounting member, a first side of the second mounting member pivotably attached to the first mounting member, a second side of the second mounting member operable to be locked to the first mounting member to receive the fan between the first and second mounting members;

wherein the first mounting member comprises a base wall and a sidewall extending from one side of the base wall, the second mounting member is pivotably attached to an upper portion of the sidewall of the first mounting member; and wherein the second mounting member comprises a base plate and two parallel side plates extending from two opposite sides of the base plate, a pivot hole is defined in each side plate, two poles extend from the upper portion of the sidewall of the first mounting member to engage in the pivot holes of the second mounting member respectively.

2. The fan assembly of claim 1, wherein the base wall of the first mounting member comprises a first flange opposite to the sidewall and two parallel second flanges connected between the first flange and the sidewall, a first hook extends from a middle of the first flange, the second mounting member comprises an end plate defining a first locking hole, the first hook is locked to the first locking hole.

3. The fan assembly of claim 2, wherein a locking slot is defined in the base wall adjacent to each of the second flanges, a substantially wedge-shaped protrusion protrudes from an inner surface bounding each of the locking slots, a locking portion is formed on a side of each of the side plates of the second mounting member to engage in the corresponding locking slot to be locked to the protrusion.

4. The fan assembly of claim 1, wherein the fan comprises a first plate and a second plate opposite to the first plate, a plurality of first mounting holes are defined in the first plate, a plurality of first posts extend from the base wall of the first mounting member for engaging in the plurality of first mounting holes of the fan.

5. The fan assembly of claim 4, wherein a plurality of second mounting holes are defined in the second plate, the base plate of the second mounting member forms a plurality of resilient tabs, a second post extends from a distal end of each resilient tab, to engage in a corresponding second mounting hole of the fan.

6. The fan assembly of claim 4, wherein a plurality of resilient members are set around the first posts of the first mounting member to be arranged between the posts and the fan.

7. The fan assembly of claim 6, wherein each of the resilient members is a substantially T-shaped hollow rubber washer.

8. A fan holder for fixing a fan, comprising:

a first mounting member; and a second mounting member, a first side of the second mounting member pivotably attached to the first mounting member, a second side of the second mounting member operable to be locked to the first mounting member to receive the fan between the first and second mounting members;

wherein the first mounting member comprises a base wall and a sidewall extending from one side of the base wall, the second mounting member is pivotably attached to an upper portion of the sidewall of the first mounting member; and wherein the second mounting member comprises a base plate and two parallel side plates extending from two opposite sides of the base plate, a pivot hole is defined in each side plate, two poles extend from the upper portion of the sidewall to engage in the pivot holes of the second mounting member respectively.

9. The fan holder of claim 8, wherein the base wall of the first mounting member comprises a first flange opposite to the sidewall and two parallel second flanges connected between the first flange and the sidewall, a first hook extends from a middle of the first flange, the second mounting member comprises an end plate defining a first locking hole, the first hook is locked to the first locking hole.

10. The fan holder of claim 9, wherein a locking slot is defined in the base wall adjacent to each of the second flanges, a substantially wedge-shaped protrusion protrudes from an inner surface bounding each of the locking slots, a locking portion is formed on a side of each of the side plates of the second mounting member to engage in the corresponding locking slot to be locked to the protrusion.

11. The fan holder of claim 8, wherein a plurality of first posts extend from the base wall of the first mounting member.

12. The fan holder of claim 11, wherein the base plate of the second mounting member forms a plurality of resilient tabs, a second post extends from a distal end of each resilient tab.

13. The fan holder of claim 11, further comprising a plurality of resilient members set around the second posts of the first mounting member, respectively.

14. The fan holder of claim 13, wherein each of the resilient members is a substantially T-shaped hollow rubber washer.

* * * * *